United States Patent [19]

Arnold

[11] 4,420,681

[45] Dec. 13, 1983

[54] GOLF BALL WARMER

[76] Inventor: Howard M. Arnold, 3704 Linwood, Royal Oak, Mich. 48073

[21] Appl. No.: 374,423

[22] Filed: May 3, 1982

[51] Int. Cl.[3] ..... H05B 3/06

[52] U.S. Cl. ..... 219/521; 219/386; 219/400; 219/429; 219/536; 219/368; 248/96; 273/32 D; 206/315.9

[58] Field of Search ..... 219/214, 217, 218, 368, 219/385, 386, 387, 400, 401, 430, 439, 429, 521, 524, 527, 536, 537; 150/1.5 R, 1.5 A, 1.5 B, 1.5 C, 52 A; 221/297; 248/96; 273/32 D, 62, 77 R; 312/49; 206/46 B, 315

[56] References Cited

U.S. PATENT DOCUMENTS

| | | | |
|---|---|---|---|
| 1,575,023 | 3/1926 | Walton | 150/1.5 R X |
| 1,829,093 | 10/1931 | Hollins | 150/1.5 C |
| 2,447,084 | 8/1948 | Moore | 219/521 X |
| 3,497,676 | 2/1970 | Gravatt | 219/521 |
| 3,683,155 | 8/1972 | Loofbourow | 219/521 |
| 3,710,978 | 1/1973 | Cosby | 221/150 X |
| 3,754,116 | 8/1973 | Godel | 219/521 X |
| 3,828,165 | 8/1974 | Collins | 219/521 |
| 3,831,001 | 8/1974 | Toomey et al. | 219/386 |
| 4,049,949 | 9/1977 | Fitzsimons | 219/521 |
| 4,155,002 | 5/1979 | Cohen | 219/521 |

FOREIGN PATENT DOCUMENTS

| | | | |
|---|---|---|---|
| 312012 | 5/1929 | United Kingdom | 150/1.5 C |

*Primary Examiner*—Volodymyr Y. Mayewsky
*Attorney, Agent, or Firm*—Duckworth, Allen, Dyer & Pettis

[57] ABSTRACT

A hinged golf ball container for mounting over the speed control resistance elements of an electric golf cart having a bottom opening through which heated air from the resistance elements can pass. A ball supporting baffle within the container protects the golf balls from radiant heat and causes circulation of the heated air around the golf balls for raising the temperature thereof. A downwardly depending deflector assists in directing heated air surrounding the resistance elements into the golf ball container.

4 Claims, 2 Drawing Figures

GOLF BALL WARMER

BACKGROUND OF THE INVENTION

1. Field of the Invention

The present invention relates to a golf ball holder which may be installed on a golf cart in a manner to heat the golf balls to improve their characteristics.

2. Description of the Prior Art

It is well known that a golf ball which is uniformly heated to a temperature of about 100° F. will travel further than a cold golf ball when driven with a golf club. Therefore, a golfer has an advantage if he can maintain his golf balls at such temperature during play on the golf course. Previous devices proposed for this purpose have provided means to heat the balls prior to play and have attempted to maintain the balls at the higher temperature by means of insulated containers. For example, U.S. Pat. No. 3,831,001 to Toomey, et al teaches a device which is connected to the conventional 110 volt household current and heats the balls to about 120° F. in a period of about six hours. The device depends upon maintaining the balls in a closed case having insulation to prevent loss of heat when in use. Gravatt, U.S. Pat. No. 3,497,676, teaches a case for holding golf balls having a light permeable case for holding golf balls in which solar heat may pass through to warm the balls and which includes an electrical battery and heating elements to work in combination with the solar heat. Cohen, in U.S. Pat. No. 4,155,002, uses a cylindrical tube having insulated walls with electrical heating resistance elements disposed therein. It is necessary to connect the Cohen heater to the household current and it is therefore dependent upon insulation to maintain the golf balls at the elevated temperatures when in use.

U.S. Pat. No. 3,828,165 to Collins teaches an insulated tube or pipe for permanent attachment to a gasoline powered golf cart contiguous with the gasoline engine exhaust manifold. Caps for the pipe permit retention of golf balls in the pipe which are heated from the engine exhaust heat. The unit is expensive, requires a permanent installation and modification to the golf cart. Control of temperature is by varying the amount of insulation. For an electric cart, Collins requires wrapping of the pipe with resistance heating wire and connection to the golf cart battery.

Thus, prior art golf ball heaters depend either upon insulated containers and preheating, upon battery operated heaters, or upon insulated holders adjacent a gasoline engine exhaust manifold. There is a need for a reliable golf ball warmer that will maintain the golf balls warm during play, that requires no additional energy source, that does require permanent installation, and that may be constructed at low cost.

SUMMARY OF THE INVENTION

With the majority of golf courses requiring golfers to utilize golf carts to speed up play, the present invention advantageously utilizes the electric resistance units commonly used in the speed control of electric golf carts to heat the golf balls to a desired temperature and to maintain that temperature during play. The unit may be easily attached to and removed from the golf cart.

To this end, I have provided a hinged container which will hold several golf balls. As will be obvious, the length of the container may be varied to suit the user. The container is mounted horizontally over the speed control resistance elements in the user's golf cart which are usually in an accessible location. I provide means for adjusting the spacing between the container and the resistance elements to permit control of the maximum temperature reached by the golf balls. The bottom portion of the container is opened to permit rising heat to pass around the golf balls which are disposed in a trough-like baffle. The baffle protects the lower surface of the golf balls from the direct radiant heat from the resistance elements in the golf cart. With the cover of the container closed, the hot air from the resistance elements rises around the baffle and circulates within the container, uniformly warming the golf balls. In some instances, I provide a flat, downwardly extending deflector projecting to the rear of the heating elements. When the golf cart is in motion, this deflector assists in directing air movement through the heating elements up and through the golf ball container.

The means for mounting the golf ball container will vary, of course, from one manufacturer's golf cart to anothers. I prefer to utilize two L-shaped brackets with the bracket attached to convenient mounting points on the golf cart adjacent the resistance elements and to provide slots in the upwardly extending portions with screws and wing nuts to attach to the front face of the golf ball container. Thus, by loosening the wing nuts, the container may be moved up and down in the bracket slots for adjustment.

It is therefore a principal object of my invention to provide a golf ball heating device which utilizes waste heat from electrical resistance units in the golf cart.

It is another object of my invention to provide a container for holding a plurality of golf balls disposed horizontally over the electrical resistance elements of the golf cart.

It is still another object of the invention to provide a mounting means on the golf ball warmer to permit control of the temperature of the golf balls.

It is yet another object of the invention to provide a container for golf balls to be warmed having a heat baffle for protecting the balls from radiant heat from the electrical resistance elements in the golf cart.

It is still another object of the invention to provide a container having a hinged lid which in its closed position causes circulation of warm air around the golf balls.

It is a further object of the invention to provide a golf ball warmer having a deflector attached thereto to assist in directing warm air flow around the golf balls.

These and other objects and advantages of my invention will be understood from the following detailed description and drawings.

DETAILED DESCRIPTION OF THE PREFERRED EMBODIMENT

Figure 1:
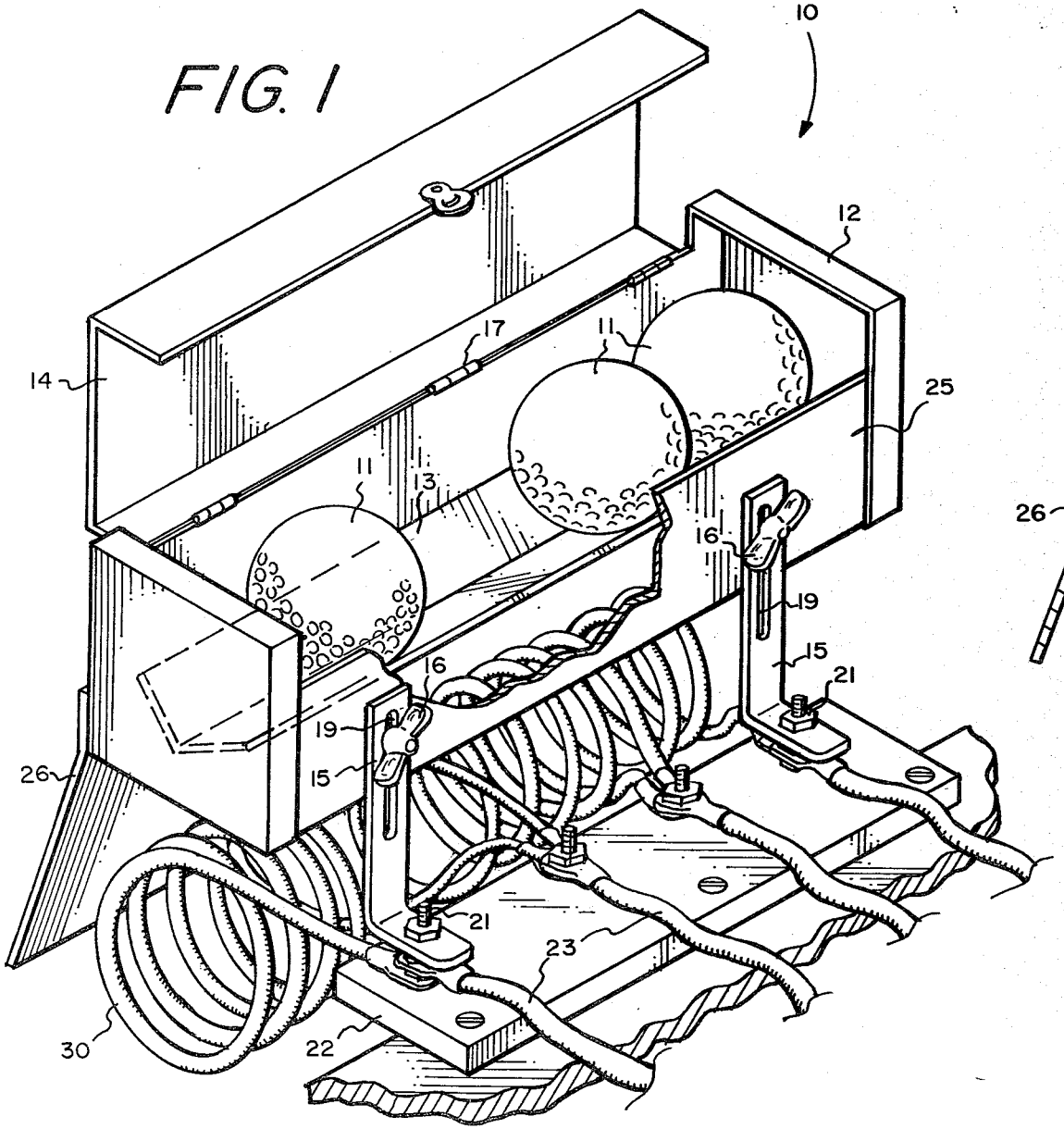
FIG. 1 is a perspective view of the container for golf balls of my invention mounted over the electrical resistance elements of an electric golf cart with a portion of the container cut away to more clearly show the baffle ball support.

Referring first to FIG. 1, I show a preferred embodiment of my invention in perspective view installed in a particular golf cart. A golf ball container shown generally at 10 is provided having an elongate box 12 having a lid 14 supported by hinges 17. As may be noted, cover 14 is shown in the open condition but is normally held closed by any type of appropriate catch. A ball supporting baffle 13, which may have a V-shape, is attached to the ends of box 12. The length of container 10 may be selected in accordance with the number of golf balls desired to be carried. The embodiment illustrated in FIG. 1, for example, is designed for four golf balls 11 with only three indicated to more clearly show the structure of baffle 13 which also serves as a ball support. In accordance with my invention, the length of baffle 13 should be slightly greater than the space required for the selected number of golf balls. Thus, a small space is left to permit balls 11 to jiggle and rotate during driving of the golf cart. This action advantageously assists in maintaining uniform warming of the balls as will be discussed hereinafter.

Figure 2:
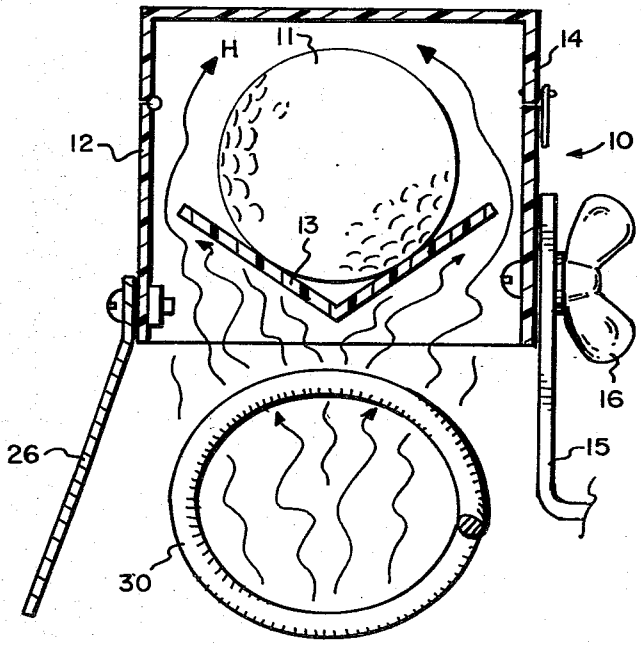
FIG. 2 is a cross sectional view of the golf ball container of FIG. 1 showing the heat flow pattern of my invention.

As best seen in FIG. 2, the bottom of box 12 is open to permit rising hot air H from resistance element 30 to pass around baffle ball support 13 into box 12. With cover 14 closed as shown, the rising heated air H circulates around golf balls 11 to uniformly heat them with baffle 13 preventing overheating of the lower sides of golf balls 11 from direct radiation. Resistance elements 30 are mounted to an insulating block 22 attached to frame 20 of the golf cart. As may be understood, resistance elements 30 are used in speed control for the electrical driving motors for the golf cart and will dissipate heat during normal driving of the golf cart. For example, in placing the golf cart in reverse, a large amount of heat is generated by resistance elements 30 and a more moderate amount during forward motion of the cart. During a normal use of the golf cart, sufficient heat is generated to maintain the golf balls in the 100° to 105° F. range which is generally considered optimum for obtaining the greatest distance from a drive. I prefer to mount container 10 so as to permit adjustment of the spacing with respect to resistance elements 30. For example, L brackets 15 are shown having slots 19 to permit adjustment of container 10. By loosening wing nuts 16, container 10 may be raised or lowered to decrease or increase the temperature of the golf balls 11. As may be recognized, variations in the weather conditions may occasion such adjustment.

L brackets 15 are shown in FIG. 1 attached to screws 21 which are already used as a junction for electrical cables 23 and for heating elements 30. It is therefore important in such installation that the front panel 25 of container 10 be of insulating material such as plastic. I prefer that container 10 be completely fabricated from plastic for low cost and durability. Deflector 26 may be thin metal. For golf cart designs which differ from FIG. 1, brackets 15 may be attached to a convenient structural member by clamps, or by bolts as will be apparent to a mechanic.

My invention has been disclosed herein with reference to a specific embodiment. However, it will be obvious to those of skill in the art to vary the size and shape of the container, the type of baffle, the construction materials and other elements without departing from the spirit and scope of the invention.

I claim:

1. For attachment to an electric golf cart having fixed electrical resistance elements for speed control of said cart, said resistance elements having sufficient electrical current flowing therethrough to produce sufficient heat during normal operation of said cart to warm golf balls, a golf ball warmer for warming golf balls comprising:

a horizontal elongate container for golf balls having a hinged cover and an opening along the bottom portion of said container, said container formed from a electrically non-conductive material;

electrically insulated mounting means for mounting said container essentially horizontally over said speed control electrical resistance elements of said golf cart; and a baffle in the form of a V-shaped trough whereby a golf ball is supported by said trough by a two-point contact therewith, said baffle disposed in and attached to said container having a shape adapted to support a plurality of golf balls, said baffle directing heated air from said electrical resistance elements into said container and protecting said golf balls from direct radiant heat from said electrical resistance;

whereby heated air rising from said electrical resistance elements circulates in said container thereby raising the temperature of said golf balls.

2. The golf ball holder as defined in claim 1 which further includes a dependant deflector attached to said container and disposed to assist in directing of heated air into said container.

3. The golf ball holder as defined in claim 1 in which said mounting means is adjustable to permit adjustment of the distance between said container and said fixed electrical resistance elements.

4. A ball holding device for maintaining golf balls at a desired temperature for installation in an electric golf cart having electrical resistance elements for speed control thereof, such elements having sufficient voltage thereacross to produce sufficient heat for warming golf balls, comprising:

electrically insulated device mounting means for mounting said ball holding device directly above said electrical resistance elements in said golf cart, said mounting means including adjustment means for adjusting the spacing between said device and said resistance elements;

an elongate container formed from electrically insulative material for holding golf balls, said container having closed end pieces, a hinged normally closed cover, and an open bottom portion, said container attached to said mounting means;

an elongate ball supporting baffle of electrically insulative material having the ends thereof attached to said end pieces, said baffle having a trough-like shape contacting a golf ball at two points only, said container and said baffle configured to permit circulation of heated air in and around golf balls when present in said container; and a deflector formed from electrically insulative material depending from said container for directing heated air from said electrical resistance elements into said open bottom portion of said container;

whereby heated air around said resistance elements resulting from operation of said golf cart is directed into and circulated in said container for maintaining said golf balls at an elevated temperature.

* * * * *